United States Patent [19]

Gaetano

[11] 4,165,710

[45] Aug. 28, 1979

[54] TENNIS SCORE KEEPING DEVICE

[76] Inventor: John Gaetano, 1143 Crane St., Suite D, Menlo Park, Calif. 94025

[21] Appl. No.: 904,516

[22] Filed: May 10, 1978

[51] Int. Cl.[2] ..... A63B 71/06

[52] U.S. Cl. ..... 116/223; 40/495; 116/4; 235/114

[58] Field of Search ..... 116/120, 133; 40/495; 235/114

[56] References Cited

U.S. PATENT DOCUMENTS

| | | | |
|---|---|---|---|
| 1,361,616 | 12/1920 | Reeves | 116/120 X |
| 1,985,652 | 12/1934 | Campbell | 235/114 |
| 2,167,271 | 7/1939 | Bowzer | 235/114 |
| 2,542,675 | 2/1951 | Hoffman | 40/495 |
| 2,889,740 | 6/1959 | Sauer et al. | 116/133 |
| 3,122,851 | 3/1964 | Sepe | 116/120 |
| 3,730,131 | 5/1973 | Izzo | 116/120 |
| 3,777,699 | 12/1973 | Pfleger | 116/120 |

*Primary Examiner*—Daniel M. Yasich

[57] ABSTRACT

A portable score keeping device for use in strenuous games such as tennis, racket ball, Ping-Pong, etc., suitable for attachment to the wrist or the waist of the player, is constructed so that successive points and games as they are scored may be fed into the device and totals shown through windows visible to the player. A novel ratchet and pawl arrangement facilitates the feeding in of data to the device and prevents errors which might be caused by improper registering or accidental movement of the mechanism during play.

2 Claims, 3 Drawing Figures

TENNIS SCORE KEEPING DEVICE

BACKGROUND OF THE INVENTION

Portable devices for keeping score or progress of sporting events are quite old in the art. A typical example is a device used by baseball umpires to record balls and strikes, as well as outs, as they are called and totalizing them for the final ruling.

The games of tennis, racket ball, ping pong, etc., present special problems especially in that the players themselves want to keep the score and know at any instant how they stand. Tennis and racket ball are particularly fast moving games and it is easy to forget the score at a given instant. The great increase in popularity of these games in recent years has increased the importance of this problem.

Any device to be effective for this purpose must be attached in some way to the person of the player. The scores must be recorded accurately and rapidly without delaying the game. The scores must be visible to the players. After recording a score or point it should not be altered or destroyed unintentionally during the strenuous movement of the players between scores.

The prior patent art in this field which is known to me at this time is set forth below.

Sepe, U.S. Pat. No. 3,122,851 employs a number of star-shaped wheels having numbers indicating scores in games or points in a given set on the projecting ends of the star-shaped wheel in each case.

Pfleger, U.S. Pat. No. 3,777,699 is a rather sophisticated device which employs a counter mechanism to totalize the scores after they are fed into the device.

Izzo, U.S. Pat. No. 3,730,131 uses a plurality of wheels having the points and sets inscribed upon their surfaces and being visible through appropriate windows through which a given point or set may be seen after it has been turned to the corresponding position. Flexible spring locking arms of star-shaped configuration are used to hold the score indicating wheels in any given set position. This probably comes closest to my invention but does not disclose or claim the novel features which I have invented as set forth below.

All of the prior art uses detents to prevent unwanted and undesirable movement of the indicating discs, dials or wheels which show the score at any one time. None of these are sufficiently positive to prevent accidental motion or to assure the player that he has advanced to the next number without a double check and chance of error.

SUMMARY OF THE INVENTION

I have invented a score keeping device which overcomes the objections present in the prior art devices and solves the problems, as well as satisfying the conditions set forth above.

I utilize two pairs of toothed or knurled wheels, one pair representing each player or doubles team. The point and game numbers are printed or otherwise embodied into the face of the wheels which are in rotative relation to the housing which contains the device. Thus, in the case of tennis, the game scores numbers 0, 15, 30 and 40 are spaced circumferentially around the face of the disc. For the set score, the numbers 1 through 6 are spaced circumferentially again around another adjacent disc.

The disc or wheels are located within a housing in which are positioned suitable windows through which the numbers may be read as they are revolved in turn into position.

An important component part of each wheel is a novel ratchet device which actually forms a part of the wheel. The ratchet device contains 4 teeth in the case of the wheels indicating the game score and 7 or more teeth in the case of the wheels indicating the set score. These will differ with other games to correspond with the scoring system used.

The ratchet wheels themselves are equipped with alternate arcuate and flat sections. These wheels in turn engage long springy pawl arms formed in a spider-like configuration located in the center of the device and engaging all four wheels. Such a combination of ratchet and pawl gives a positive action to the wheels so they cannot move accidentally while the player is in motion. The action of the pawl as it rides over the flat and then along the arcuate section and finally snaps into position on the tooth face itself is to give it a sharp and loud snap which may be readily felt and heard by the player. It is thus not necessary for him to even look at the window in each case to assure himself that he has moved the scoring wheel to the next position.

An additional lever type arm is incorporated in the device which may be swung back and forth by means of a knurled end, and through its own window, show to the player whether the advantage is his or in his opponent's favor or the game stands at deuce, these terms being well known to participants in the game of tennis and racket ball.

The whole device is encased in a compact small package and may be molded entirely from plastic. It is further constructed to clamp around the wrist of the player or attach to his belt.

DESCRIPTION OF A PREFERRED EMBODIMENT

Figure 1:
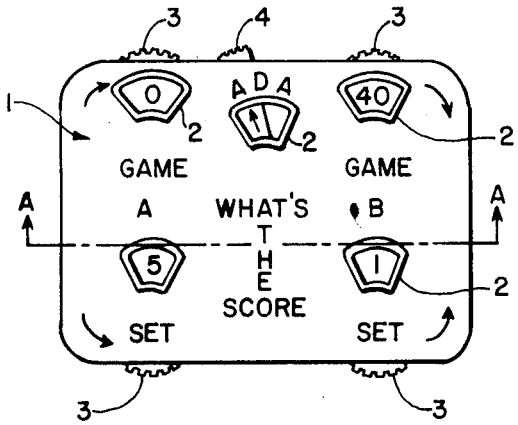
FIG. 1 is a plan or front view of the device, on which may be seen the status of the game at any given instant.
Figure 2:
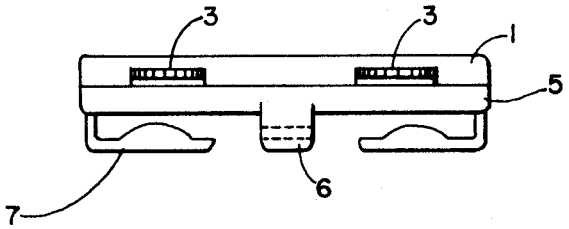
FIG. 2 is an elevation view of FIG. 1.

Referring now to the figures, the embodiment described applies particularly to tennis, but the same general construction may be used for score keeping devices for other games. There is seen first, top cover 1 in which are cut the windows 2. The knurled or toothed wheels 3 are located behind and protrude beyond the top cover of the device. Also located internally is the knurled or toothed lever 4. The boss 6 serves to support the innards as described more fully below. The clamps 7 serve to attach the device to a wrist band worn by the player or to his belt.

Figure 3:
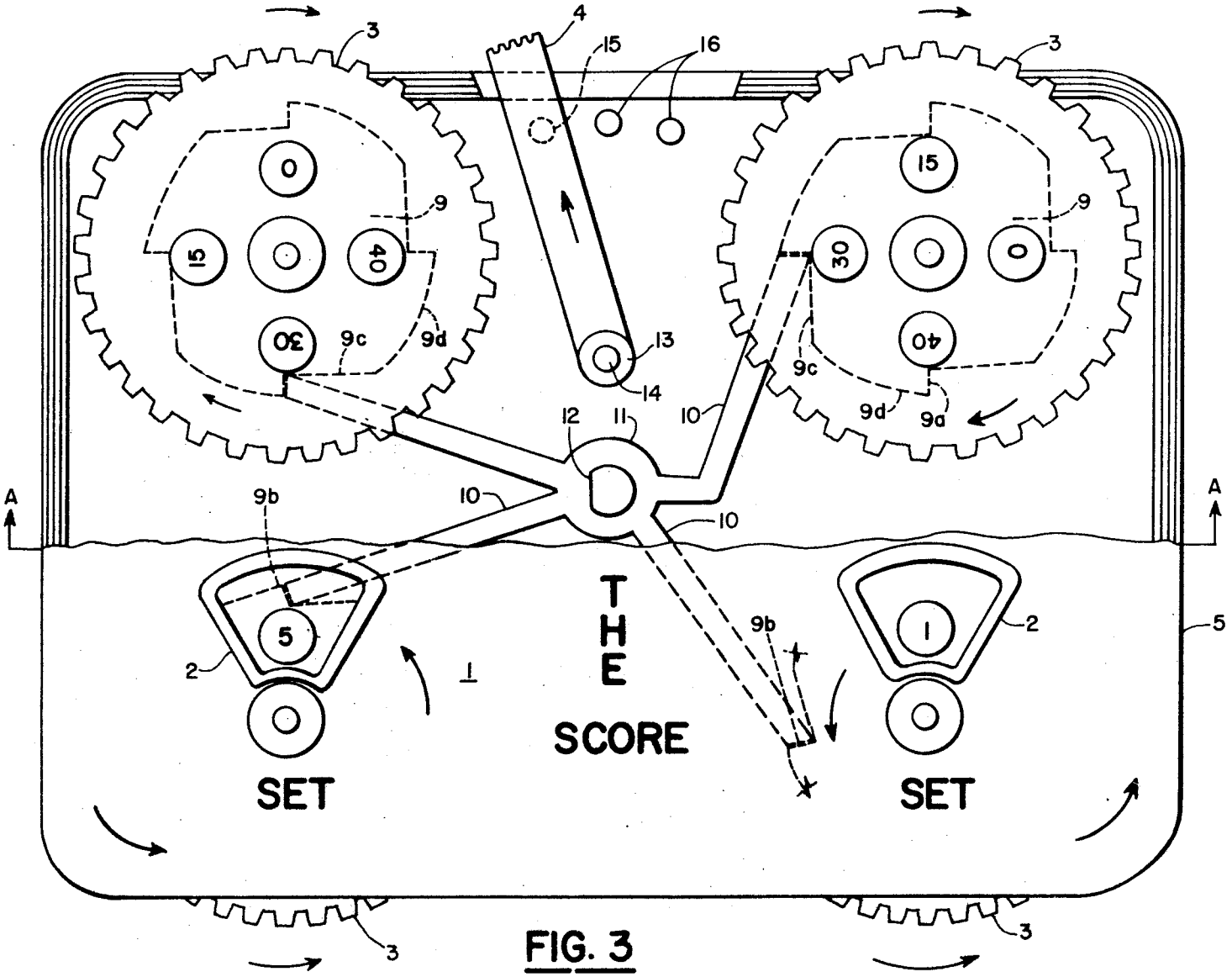
FIG. 3 is a plan view partially cut away to show the internal workings of the ratchet and pawl combination, as well as the advantage indicating lever.

Refer now more particularly to FIG. 3, which shows the top cover 1 cut away along the lines A—A. There is seen here the ratchet members 9, each being positioned upon and forming an integral part of the wheels 3.

Each ratchet member comprises a plurality of teeth, each tooth having a stop section section at *9a*, or *9b* and a flat section shown at *9c* and an arcuate section shown at *9d*. The number of teeth in each ratchet member will vary with the scoring system of the game being played, each tooth representing a unit of score. As stated above, the particular illustration shows the device as used in tennis. In this case, the ratchet members registering the game score will have four teeth corresponding to the scores 0, 15, 30, and 40. The ratchet members registering the set score will have seven teeth corresponding to the numbers 0, 1, 2, 3, 4, 5, 6. Of course, more may be added if desired. I have found, however, in the case of tennis, longer sets may be scored by merely continuing around from 1 again until either player or teams shows two more games than the other and then adding the figures shown to 6. This will give the final score. The important features of my device are still preserved in any event.

Spring pawls 10 which take the form of spider-like arms are positioned and form an integral part of hub 11 which is keyed in position by means of key 12. The advantage indicating lever 4 is equipped with a hub 13 which rotates on pin 14. It is equipped with a projection 15 which engages detent holes 16 and thus positions the lever to show which side has the advantage "A" and whether the game is at deuce "D" by the arrow seen through its own particular window 2.

OPERATION

In the case of tennis, at the start of the game, of course, the wheels are set so that all indicators show 0. As the first point is scored, the player turns wheel 3 to the next tooth on the ratchet which will bring the number 15 under the window. This takes place as follows. The arrows on the drawings and on the device show the direction of rotation.

As ratchet member 9 moves around the flat surface 9c it causes spider arm 10, which is constructed of springy material, to deflect outwards until arcuate portion 9d makes contact with it. While thus in a condition of tension, the arm 10 continues to engage the arcuate portion 9d of the ratchet tooth until the next stop section 9a comes into position. At this point, and when number 15 is in register with the window 2, arm 10 snaps into position against stop section 9a. This is a sharp and positive locking action which the player can easily feel and even hear, thereby knowing that he has registered that score properly.

Similar operation takes place as the game progresses in score until it is won by one side or the other, after which the lower wheels indicating the status of the set in games from 1 to 6 is moved to a ratchet position whereby the number 1 is visible through window 2. Of course, I may construct my wheels indicating the set score and any number of points by merely supplying ratchet members having a different number of teeth with the corresponding numbers on them to take care of larger set scores. This does not, however, in any way change the principle of operation of may ratchet and pawl and scoring devices. I have found, however, that this is not entirely necessary as set forth above.

When one side or the other has the advantage, "A", the lever 4 is moved to a position adjacent to that particular side showing the advantage in that side through the window. If the game goes to deuce, the lever 4 is moved to its center position "D" indicating that fact and if the advantage goes the other way it is moved over to the other side. The arrow shown facilitates reading at this point.

In this manner, the score at any time is readily visible, may be kept with speed and accuracy, and cannot be accidentally changed to the wrong numbers while the game is in progress.

I may construct my device of any suitable material, but I prefer to mold it out of commercial plastics utilizing sonic welding to join the component parts as is well known to those skilled in the art. I have found, for example, that the material known as "calcon" is particularly well suited for my spider arms 10 since these require a substantial amount of springiness or flexibility.

I claim:

1. A tennis score keeping device comprising:

a housing of generally flat configuration;

a plurality of wheels rotatably mounted within said housing so that a portion of their peripheries project slightly beyond the outer edge of said housing;

a series of numbers positioned in sequence circumferentially and concentrically upon one face of each of said wheels;

windows through said housing positioned against said faces of said wheels so that one of said numbers is visible through said windows at a time as said wheels are rotated;

ratchet means fixedly positioned upon the face of each of said wheels concentrically therewith and forming a part thereof;

said ratchet means being characterized by a plurality of ratchet teeth, each of said teeth being aligned with one of said numbers;

pawl means fixedly positioned within said housing and disposed to engage said ratchet means;

said pawl means being characterized by a plurality of elongated arms projecting radially from a central point within said housing in spider-like formation;

each of said arms being disposed to slidably engage said ratchet teeth on one of said ratchet means;

said ratchet teeth being characterized by, a radial section;

a flat section at right angles to said radial section and connecting therewith;

an arcuate section connecting said flat section with the radial section of the succeeding tooth;

said elongated arms of said pawl means being made of a springy material and disposed to slidably engage in turn said flat section and said arcuate section of said ratchet teeth when said wheels are rotated and to engage positively said radial section of said ratchet teeth when said wheels are stationary;

said engagement of said radial section being effected with considerable force and creating an audible sound.

2. The device of claim 1 in which said projecting peripheries of said wheels comprise a series of teeth.

* * * * *